United States Patent [19]

Kaufmann

[11] 4,300,828

[45] Nov. 17, 1981

[54] PHOTOSENSITIVE SHEET PROCESSOR

[75] Inventor: Kenneth M. Kaufmann, Minneapolis, Minn.

[73] Assignee: Pako Corporation, Minneapolis, Minn.

[21] Appl. No.: 168,030

[22] Filed: Jul. 14, 1980

[51] Int. Cl.[3] ..... G03D 3/08

[52] U.S. Cl. ..... 354/322; 354/298; 354/319; 134/57 R

[58] Field of Search ..... 354/322, 324, 298, 319, 354/320; 134/64 P, 122 P, 113, 57 R; 250/561, 571; 219/216; 355/106

[56] References Cited

U.S. PATENT DOCUMENTS

| | | | |
|---|---|---|---|
| 3,763,758 | 10/1973 | Manack et al. | 354/298 |
| 3,852,793 | 12/1974 | McClintock | 354/324 |
| 3,927,417 | 12/1975 | Kinoshita et al. | 354/298 |
| 4,057,817 | 11/1977 | Korb | 354/298 |

*Primary Examiner*—Joseph W. Hartary
*Assistant Examiner*—S. D. Schreyer
*Attorney, Agent, or Firm*—Kinney, Lange, Braddock, Westman and Fairbairn

[57] ABSTRACT

A processor of sheets of photosensitive material includes an entrance opening through which sheets enter the processor, developer, fix and wash tanks; a dryer; an exit opening through which the sheets exit the processor; and a transport system for transporting the sheets through the processor. Signals from a film sensor positioned proximate the entrance opening indicate when a leading edge and a trailing edge of each sheet enters the processor. An encoder provides signal pulses for each incremental movement of a drive shaft which drives the transport system. The signal pulses, which provide an indication of the linear travel of the sheets through the processor, are counted. Based upon the signals from the film sensor and the counted pulses, a signal is provided when the trailing edge of the last sheet passes out of the developer tank, so that the speed of the transport can be changed without affecting the developing of the images on the last sheet. Another signal is provided which indicates when the trailing edge of the last sheet enters the wash tank. This signal is used to indicate when previously processed sheets may be fed back into the wash tank of the processor for rewashing and redrying without interfering with the last sheet being processed.

6 Claims, 4 Drawing Figures

PHOTOSENSITIVE SHEET PROCESSOR

BACKGROUND OF THE INVENTION

1. Field of the Invention

The present invention relates to processors of sheets of photosensitive material.

2. Description of the Prior Art

Automatic photosensitive film and paper processors transport sheets or webs of photosensitive film or paper through a sequence of processor tanks in which the photosensitive material is developed, fixed and washed, and then transports the material through a dryer.

In the case of graphic arts film and paper processors, the photosensitive film or paper is typically in the form of strips or sheets. To perform dot etching, it is necessary to rewash and redry sheets of previously processed material in a graphic arts processor. To accommodate rewashing, graphic arts processors such as the 24ML processor manufactured by Pako Corporation, the assignee of the present application, provide a built-in rewash slot. In the 24ML processor, the rewash slot is located at the top of the processor, on the light room side (rather than the dark room side) of the processor. When a sheet of material is fed into the rewash slot, it is directed downward into the wash tank, and is then transported through the dryer. The 24ML processor includes a rewash switch which is turned on when an operator desires to feed a sheet into the rewash slot, and a rewash wait light. After rewash switch has been turned on, the rewash wait light remains on until the last sheet being fed through the processor drops into the catch basket at the exit of the processor.

Processors of photosensitive material commonly include a sensor or sensors at the inlet end of the processor. Signals from the film sensor are used to activate the transport system of the processor, and in some cases to operate other systems as well. For example, U.S. Pat. No. 4,057,817 by Korb et al shows an x-ray film processor in which the presence of film at the infeed tray of the processor causes a timer to be activated. This timer operates the processor control to switch the processor from a normal standby mode to a processing mode for a preset timing interval. This minimizes the water and energy consumption of the processor.

U.S. Pat. No. 3,852,793 by McClintock shows a photographic film processor having a film sensing switch at the inlet end of the processor which activates and controls flow of water into the processor. When the trailing edge of a piece of film passes the switch, a timer begins a timing cycle. If no further film enters the processor before the end of the timing cycle, the water to the processor is turned off. If a subsequent film enters the processor during the timing cycle, the timer is reset. Water to the processor is turned off after a predetermined period of time has elapsed after the trailing edge of the last piece of film has entered the processor.

SUMMARY OF THE INVENTION

In the processor of the present invention, material sensing means positioned proximate an entrance opening of the processor senses presence of sheets of photosensitive material entering the processor. Signals are provided which indicate when the leading edge and the trailing edge of each sheet enters the processor. Signal pulses are produced which indicate incremental lineal travel through the processor. The signals from the material sensing means and the signal pulses are used to generate signals indicative of when an edge of the last sheet to enter the processor reaches predetermined locations in the processor.

In a preferred embodiment of the invention, a signal is provided which indicates when the trailing edge of the last sheet has passed out of the developer tank. As long as any sheet of photosensitive material is in the developer tank, the transport speed of the sheets through the processor must remain constant. The present invention, however, permits a change in transport speed as soon as the signal is received indicating that the trailing edge of the last sheet has passed out of the developer tank.

In another embodiment of the present invention, a rewash switch provides a signal indicating when rewashing of a previously processed sheet is desired, and a rewash indicator indicates to an operator the sheet may be fed into the processor for rewashing. In this embodiment, a signal is provided when the trailing edge of the last sheet has entered the wash tank. Based upon this signal, the rewash indicator indicates that rewashing may begin, since the trailing edge of the last sheet has entered the wash tank and therefore cannot interfere with the material to be rewashed, and no further sheets have been fed into the processor through the entrance opening. By providing an indication of rewash availability as soon as the last sheet has entered the wash tank, rather than after the last sheet of material has been dried and deposited in the receiving rack, a significant saving in time and increase in productivity of the processor can be achieved.

DETAILED DESCRIPTION OF THE PREFERRED EMBODIMENTS

Figure 1:
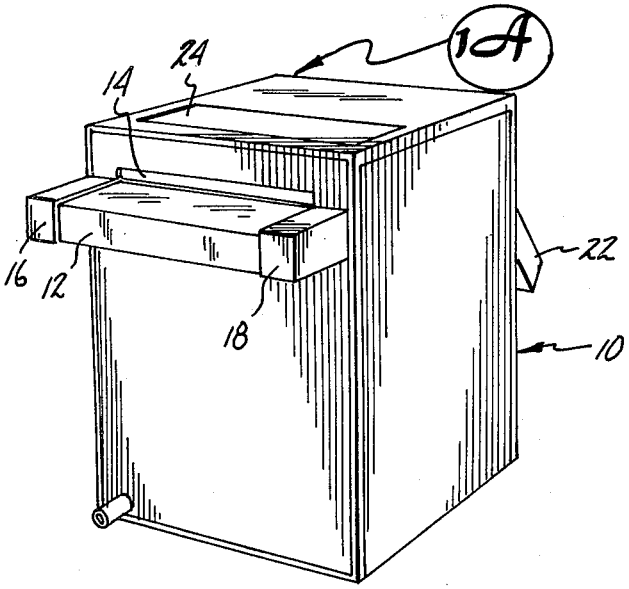
FIG. 1 is a perspective view of a graphic arts processor which utilizes the present invention.
Figure 1A:
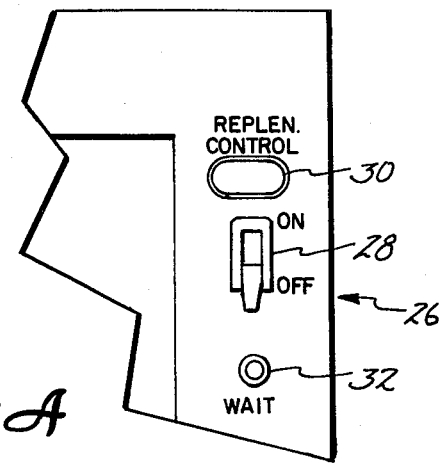
FIG. 1A shows a rewash control panel located at the rear end of the processor of FIG. 1.

FIG. 1 shows graphic arts processor 10, which utilizes the improved control system of the present invention. Processor 10 has a feed table 12 upon which sheets of photosensitive material are fed into the processor through entrance opening 14.

Positioned on opposite sides of feed table 12 are left and right control pods 16 and 18, respectively. In a preferred embodiment of the present invention, left control pod 16 includes various manually operated switches, including a power switch for turning on the processor, a wait light and a feed annunciator. Both the wait light and the feed annunciator indicate to the operator when another sheet of photosensitive material can be fed into entrance opening 14.

Right control pod 18 preferably includes a keyboard and push button switches, together with a display. The keyboard, switches and display are used for entering control information such as replenishment rates, transport speeds, temperatures, and the like, and for selecting one of various combinations of control parameters for use with a particular type of photosensitive sheet material. The front end of processor 10, including feed table 12, entrance opening 14, and left and right control pods 16 and 18, is located in a dark room to avoid exposure of the sheets of photosensitive material being fed into the processor.

The remaining portion of processor 10 is preferably located on the opposite side of a wall (not shown) from the front end of processor 10. The remainder of the processor does not have to be maintained in darkness, and the room in which the remainder of processor 10 is located is preferably a "light room" rather than a "dark room".

Sheets which have been entered through entrance opening 14 are transported through the processor, and are eventually driven out of the rear end of processor 10 through exit opening 20 (shown in FIG. 2) and into catch tray or basket 22.

In graphic arts processing, it is desirable to rewash and dry previously processed sheets. Processor 10 has a built-in rewash entrance slot 24 in its top surface through which previously processed sheets may be fed into processor 10 for rewashing and drying. Located at the left rear end of processor 10 is rewash control panel 26. Rewash control panel 26 includes rewash switch 28, which signals the control system of processor 10 that rewashing is desired. Rewash ON light 30 indicates that the rewash system is on, and rewash weight light 32 indicates to the operator in the light room he cannot yet feed material into rewash entrance slot 24.

Figure 2:
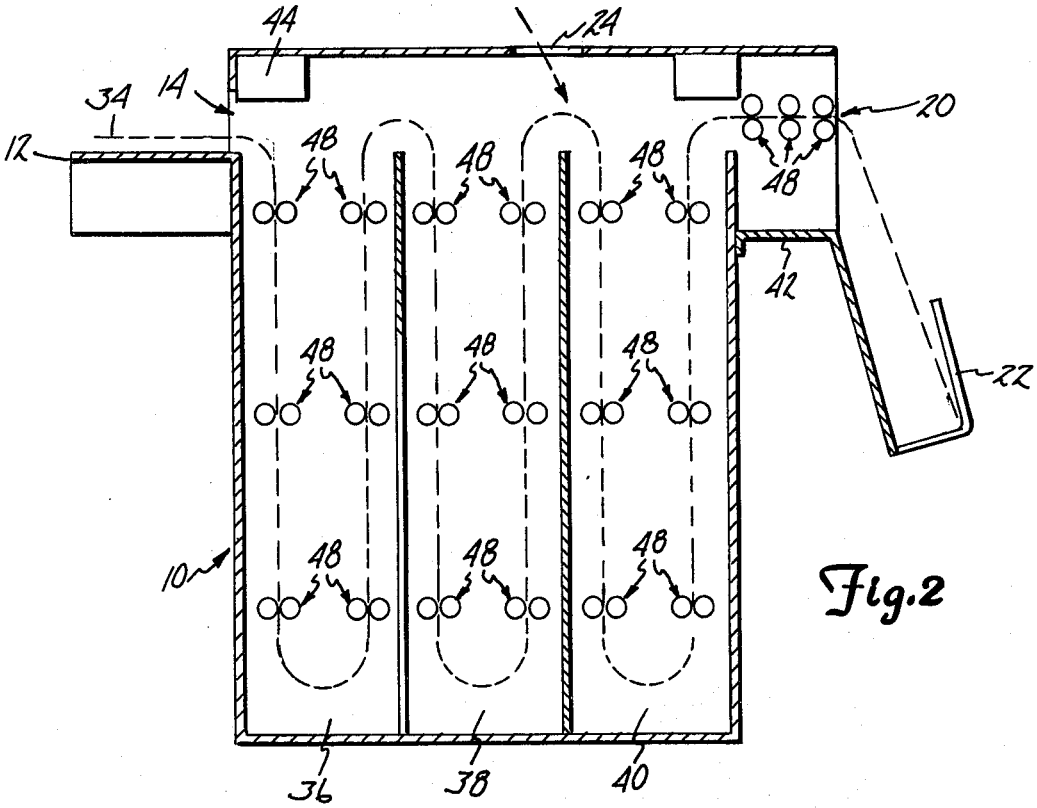
FIG. 2 is a schematic representation of the path of photosensitive sheets through the processor of FIG. 1.

FIG. 2 is a schematic representation, not to scale, of processor 10. In FIG. 2, a dashed line 34 illustrates the path of sheets of photosensitive material through processor 10.

As shown in FIG. 2, processor 10 includes developer tank 36, fix tank 38, wash tank 40, and dryer 42. Positioned proximate opening 14 is film width sensor 44, which provides signals indicative of width whenever a sheet is present at entrance opening 14. In a preferred embodiment, film width sensor 44 comprises reflective infrared (IR) sensor array. The signals from film width sensor 44 not only provide an indication of the width of the sheet entering the processor, but also provides an indication of the occurrence of the leading edge and trailing edge of each sheet, since the signals from film width sensor 44 will change significantly as each leading and trailing edge is encountered.

Located at a position at which sheets leave wash tank 40 and enter dryer 42 is density scanner 46. Signals from density scanner 46 (and from width sensor 44) are used in determining appropriate amounts of replenishment of processor chemistry.

Figure 3:
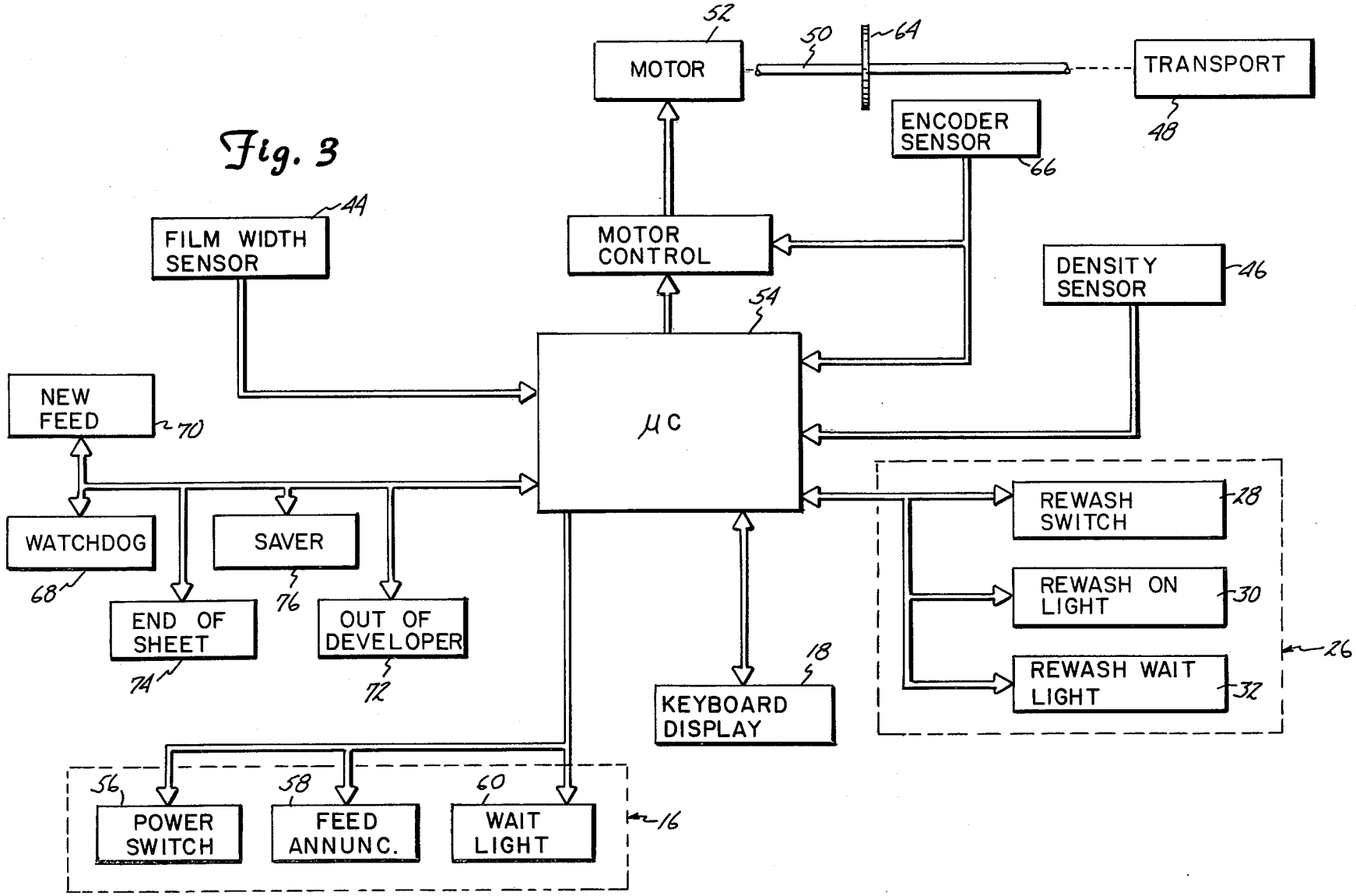
FIG. 3 is a block diagram of a control system of the present invention.

In FIG. 2, sheet path 34 is shown as passing between a plurality of roller pairs located in tanks 36, 38, 40 and dryer 42. These roller pairs, which are designated generally by reference numeral 48, form a transport system for transporting these sheets through the processor. In preferred embodiments of the present invention, the rollers of transport 48 are driven by a common drive shaft 50 shown in FIG. 3 through a drive train which may take one of a variety of well known forms. As illustrated in FIG. 3, drive shaft 50 is driven by electric motor 52.

FIG. 3 illustrates the control system of the present invention. As shown in FIG. 3, microcomputer 54 controls the operations of processor 10. Microcomputer 54 receives input signals from power switch 56 (as well as a number of other manually controlled switches which are not shown) of left control pod 16, from the keyboard of right control pod 18, and from rewash switch 28 of rewash control panel 26. Microcomputer 54 provides output signals to control feed annunciator 58 and wait light 60 of left control pod 18, to control the display of right control pod 18, and to control rewash ON light 30 and rewash wait light 32 of rewash control panel 26.

Microcomputer 54 also receives signals from film width sensor 44 and density sensor 46. These signals are used both for the control functions of the present invention, as well as in controlling the replenishment of processor fluids.

Microcomputer 54 controls motor 52 through motor control 62. In one preferred embodiment, motor control 62 is a separate microcomputer which is used solely for motor control functions, while microcomputer 54 controls overall functions of the processor 10.

Control of the speed of motor 52 is a closed loop type of control. Mounted on drive shaft 50 is encoder wheel 64, which preferably is a slotted metal disk having a plurality of slots around its periphery. Encoder sensor 66, which is preferably a Hall switch sensor or an optical encoder sensor, provides logic level electrical pulses as each slot of encoder wheel 64 passes. The output pulses of encoder sensor 66 are provided to motor control 62 to provide feedback control of motor speed.

The output pulses of encoder sensor 66 are also provided to microcomputer 54. Since each pulse is indicative of incremental rotation of shaft 50, the lineal movement of sheet material through processor 10 may be monitored by microcomputer 54 by counting the pulses. In addition, since the length of path 34 through processor 10 is known, microcomputer 54 can determine the distance that a sheet has progressed through processor 10 by counting the encoder output pulses.

In the processor of the present invention, microcomputer 54 monitors the leading and trailing edges of sheets of material being transported through processor 10, and controls operation of processor 10 as a function of the location of the leading or trailing edge of the sheets. In the embodiment shown in FIG. 3, microcomputer 54 uses watch dog counter 68, new feed counter 70, out-of-developer counter 72, end-of-sheet counter 74, and saver counter 76 to provide signals when a leading or trailing edge of a sheet has reached selected positions within processor 10. These signals are used by microcomputer 54 to inhibit or permit various functions of the processor to occur.

In particular, watch dog counter 68 is used to ensure that the sheets are in fact being transported through processor 10. Since the distance between film width sensor 44 and density sensor 46 is known, microcomputer 54 uses watch dog counter 68 to count pulses from the time that a leading edge of the sheet is detected by film width sensor 44. If watchdog counter 68 reaches a predetermined count before density sensor 46 senses the leading edge of the sheet, this indicates that the transport system is not functioning properly. Microcomputer 54 then provides a warning to the operator indicating a possible error condition.

New feed counter 70 is set by microcomputer 54 as the trailing edge of a sheet clears film width sensor 44. In a preferred embodiment of the present invention, microcomputer 54 loads new feed counter 70 with a number corresponding to the number of encoder pulses needed to drive the trailing edge of the sheet past the first set of rollers of developer tank 36. The encoder pulses count new feed counter 70 downward toward zero. When the count in new feed counter 70 reaches zero, microcomputer 54 turns on feed annunciator 58 and turns off wait light 60, thereby permitting the operator to feed another sheet into entrance of opening 14. New feed counter 70, therefore, assures that the trailing edge of the previous sheet is out of the way before a new sheet is fed into the processor.

Out-of-developer counter 72 is loaded with a number of pulses corresponding to the lineal travel needed so that the trailing edge of the last sheet fed into the processor has cleared developer tank 36. The count in out-of-developer counter 72 is counted down by the encoder pulses. When the count reaches zero, microcomputer 54 no longer inhibits a change in processor transport speed. If the operator, through the keyboard of control pod 18 attempts to change transport speed (for example by selection control parameters for different type of material), microcomputer 54 prevents this speed change from occurring until out-of-developer counter 72 has reached zero. Since the time of the sheet in the developer is the most critical parameter in the proper processing of the sheet, microcomputer 54 prevents any change of speed until the trailing edge of the last sheet is out of the developer tank 36.

End-of-sheet counter 74 is loaded by microcomputer 54 with a value corresponding to the number of pulses required to transport the trailing edge of the last sheet to a point where the trailing edge has cleared the first set of rollers in wash tank 40. Until end-of-sheet counter 74 has been counted to zero, microcomputer 54 maintains rewash wait light on. It is only after end-of-sheet counter 74 has reached zero that rewash wait light 32 goes out, thereby indicating that the operator in the light room can feed material through rewash entrance slot 74 into the processor for rewashing and redrying.

Once rewash wait light 32 goes out, the operator in the light room can continue to feed material into the processor for rewashing until he turns off rewash switch 28. During this time period, wait light 60 in the dark room is on and feed annunciator 58 is off, thereby inhibiting the operator in the dark room from feeding any further sheets until rewashing is completed.

Each time a new sheet is fed into entrance opening 14 and sensed by film width sensor 44, counters 70, 72, 74 and 76 are reset. As a result, the operator in the dark room has priority in feeding sheets into the processor. When rewash switch 28 is on, both rewash ON light 30 and rewash wait light 32 will be turned on, but rewash wait light 32 will not be extinguished until end-of-sheet counter 74 reaches zero. Once the last sheet fed had cleared the first set of rollers of wash tank 40 without another sheet being fed into entrance opening 14 and detected by film width sensor 44, rewash wait light 32 goes out, and rewashing has priority until rewash switch 28 is turned off.

The control system of the present invention permits rewashing of material as much as forty percent sooner than has been possible in the prior art, in which the operator had to wait until the final sheet dropped into the tray before material could be fed into the processor for rewashing. The present invention permits much eariler feeding of material into the processor for rewashing because the lineal travel of the trailing edge of the last sheet fed into the processor is monitored, and as soon as the last sheet has entered the wash tank and is beyond a point where it could interfere with rewash material, rewashing is permitted.

Saver counter 76 is set by microcomputer 54 with a count equal to the number of pulses corresponding to the distance between film width sensor 74 and exit opening 20. When saver counter 76 reaches zero, this indicates that the trailing edge of the last sheet entered into the processor has cleared exit opening 20, and no further sheets are in processor 10. At this point, microcomputer 54 causes motor control 62 to reduce the drive speed of transport 48 to either a very low (creep) speed, or turns the transport speed to zero.

Once processor 10 has transferred into a saver mode, rewashing can occur, since this indicates that no further material is being fed into processor 10 through entrance opening 14. If saver counter 76 has reached zero and rewash switch is turned on, microcomputer 54 provides signals to motor control 62 to increase transport 48 to process speed and turns on wait light 60, so that an operator in the dark room cannot feed in further material until rewashing is complete. Wait light 60 remains on until rewash switch 28 is turned off.

Table A illustrates the steps performed by microcomputer 54 in controlling processor 10 as a function of encoder pulses and the counts contained in watchdog counter 68, new feed counter 70, out-of-developer counter 72, end-of-sheet counter 74, and saver counter 76. Table B illustrates the functions of microcomputer 54 with respect to rewash switch 28, showing how rewash requests are coordinated with the operation of end-of-sheet counter 74, saver counter 76, rewash wait light 32, and wait light 60.

TABLE A

A.1 Power switch 56 "ON"
A.2 Process speed programmed
A.3 Reflective sensors 44 sense film
A.4 If WAIT light 60 on then blink as a warning and
(1) Start WATCHDOG counter 68
(2) Stop counters 70, 72, 74 and 76
(3) Turn on REWASH WAIT light 32
(4) Turn on WAIT light 60
(5) Read speed from memory
A.5 Increase pulses to bring up to processing speed and
(1) Check pulses from drive shaft else ERROR
A.5.1 After 65 inches of travel (leading edge) without density signal from sensor 46
WATCHDOG counter 68 reaches zero—ERROR
A.6 Reflective sensors 44 clear
A.7 Restart SAVER counter 76 and
(1) Start END-OF-SHEET counter 74
(2) Start OUT-OF-DEV counter 72
(3) Start NEW FEED counter 70
A.8 After 3.5 inches of travel (trailing edge), NEW FEED counter 70 reaches zero
(1) Turn off WAIT light 60
(2) Turn on FEED annunciator 58
A.9 After 31 inches of travel (trailing edge), OUT-OF-DEV counter 72 reaches zero if speed change request
(1) Allow speed change
(2) turn off WAIT light 60
(3) Turn on FEED annunciator 58
A.10 After 47.0 inches of travel (trailing edge) END-OF-SHEET counter 74 reaches zero
(1) Turn off REWASH WAIT light 32
A.11 After 78.0 inches of travel (trailing edge) SAVER counter 76 reaches zero
(1) Transport speed drops to OFF or CREEP speed (optional).

TABLE B

B.1 Power switch "ON"
B.2 Process speed programmed
B.3 Rewash switch turned "ON"
B.4 Rewash request generated
B.5 If END-OF-SHEET counter 74 zero and
(1) Transport PROCESS speed
(2) Rewash request acknowledged
then
(1) Turn on WAIT light 60
(2) Allow SAVER counter 76 to count to zero
(3) Turn on REWASH 'ON' light 30 or
B.5.1 If SAVER counter 76 zero and rewash request acknowledged then
(1) Increase transport to PROCESS speed
(2) Turn on WAIT light 60
(3) Turn off REWASH 'ON' line 30
B.5.2 If rewash request not acknowledged
(1) Wait for END-OF-SHEET counter 74 to reach zero
(2) Go to B.5
B.6 Rewash switch 28 turned "OFF"
B.7 If from B.5 and
(1) SAVER counter 76 not zero
then
(1) Return control to SAVER counter 76
(2) Turn off WAIT light 60
(3) Turn off REWASH 'ON' light 30 or
B.7.1 If from B.5 and SAVER counter 76 zero
(1) Transport speed drops to OFF or CREEP speed (optional)
(2) Turn off REWASH 'ON' light 30
(3) Turn off WAIT light 60
or
B.7.2 If from B.5.1 then
(1) Go to B.7.1.

In conclusion, the control system of the present invention monitors lineal travel of the edges of the last sheet to be fed into the processor. By sensing pulses, which are indicative of lineal travel of the sheets, microcomputer 54 coordinates the operation of the speed control to prevent a change of speed while material is in the developer tank; and coordinates operation of control pod 16, and rewash control panel 26 to permit rewashing of material as soon as rewashing will not interfere with material fed into the processor through main input entrance opening 14 in the dark room. This significantly increases the efficiency of operation of the processor for both normal production and rewashing.

Although the present invention has been described with reference to preferred embodiments, workers skilled in the art will recognize that changes may be made in form and detail without departing from the spirit and scope of the invention.

What is claimed is:

1. In a processor of sheets of photosensitive material having developer, fix, and wash tanks containing processing fluid for photoprocessing the sheets, a dryer for drying the sheets, an entrance opening through which the sheets enter the processor, an exit opening through which the sheets exit the processor, and means for transporting sheets through the processor, an improvement comprising:

first material sensing means positioned proximate the entrance opening for sensing presence of sheets entering the processor and providing signals indicating when a leading edge and a trailing edge of each sheet enters the processor;

travel sensing means for providing signals indicative of incremental lineal travel of sheets through the processor;

means for providing an out-of-developer signal indicating that a trailing edge of a last sheet to enter the processor has passed out of the developer tank, based upon signals from the material sensing means and the travel sensing means;

means for controlling transport speed at which the sheets are transported through the processor;

operator actuated means for providing signals requesting a change in transport speed; and means for inhibiting the means for controlling transport speed from changing transport speed in response to the signals from the operator actuated means while a sheet is in the developer tank, and permitting a change in transport speed in response to the signals from the operator actuated means after the out-of-developer signal is provided.

2. The invention of claim 1 wherein the means for transporting includes motor means, a drive shaft driven by the motor means, and a plurality of sheet engaging rollers driven by the drive shaft; and wherein the travel sensing means includes a shaft encoder attached to the drive shaft, and an encoder sensor for providing encoder signal pulses in response to incremental rotation of the drive shaft.

3. The invention of claim 2 wherein the means for providing signals comprises:

counter means for counting in response to the encoder signal pulses;

means responsive to signals from the first material sensing means for enabling the counter means to count in response to the encoder pulse signals from a predetermined value toward a second predetermined value, the number of encoder pulse signals required to count from the first to the second predetermined value corresponding to a lineal distance travelled by the trailing edge of the last sheet from the first material sensing means to a predetermined location beyond the developer tank; and means for providing a signal when the counter means reaches the second predetermined count.

4. The invention of claim 3 wherein the means responsive to signals from the first material sensing means resets the counter means in response to a signal indicating when the leading edge of a sheet enters the processor and enables the counter means in response to a signal indicating when the trailing edge of the sheet enters the processor.

5. In a processor of sheets of photosensitive material having developer, fix, and wash tanks containing processing fluid for photoprocessing the sheets, a dryer for drying the sheets, an entrance opening through which the sheets enter the processor, an exit opening through which the sheets exit the processor, and means for transporting sheets through the processor, an improvement comprising:

first material sensing means positioned proximate the entrance opening for sensing the presence of sheets entering the processor and providing signals indicating when a leading edge and a trailing edge of each sheet enters the processor;

travel sensing means for providing signals indicative of incremental lineal travel of sheets through the processor;

second material sensing means for sensing material at a predetermined location between the wash tank and the exit opening and for providing a signal indicating presence of a sheet at the predetermined location;

means for providing a signal indicating that the leading edge of a sheet has reached the location of a second material sensing means, based upon the signals from the first material sensing means and the travel sensing means; and means for providing an error indication if the second material sensing means has not yet sensed material when the signal indicating that the leading edge of a sheet has reached the location of the second material sensing means has been provided.

6. The invention of claim 5 wherein the processor further includes a rewash entrance opening through which previously processed sheets may be fed back into the wash tank for rewashing and redrying; and further comprising:

means for providing an end-of-sheet signal indicating that a trailing edge of a last sheet to enter the processor has entered the wash tank, based upon signals from the material sensing means and the travel means;

rewash switch means for providing a signal indicating that rewashing of a sheet is desired; and rewash switch means indicating when a sheet may be fed into the rewash entrance opening, the rewash indicator being controlled as a function of the end-of-sheet signal.

* * * * *